United States Patent [19]

Brega

[11] Patent Number: 4,969,340

[45] Date of Patent: Nov. 13, 1990

[54] DEVICE FOR TENSIONING KNITTED FABRIC IN A CIRCULAR KNITTING MACHINE, IN PARTICULAR OF THE LARGE-DIAMETER TYPE

[75] Inventor: Angelo Brega, Varese, Italy

[73] Assignee: MEC-MOR S.r.l., Induno Olona, Italy

[21] Appl. No.: 337,212

[22] Filed: Apr. 12, 1989

[30] Foreign Application Priority Data

Apr. 29, 1988 [IT] Italy ..... 20396 A/88

[51] Int. Cl.[5] ..... D04B 15/88

[52] U.S. Cl. ..... 66/149 R; 66/150

[58] Field of Search ..... 66/149 R, 150, 151, 66/152; 139/303, 304, 305

[56] References Cited

U.S. PATENT DOCUMENTS

| | | | |
|---|---|---|---|
| 2,345,698 | 4/1944 | Bromley et al. | 66/150 |
| 4,777,808 | 10/1988 | Kühnert | 66/152 |

FOREIGN PATENT DOCUMENTS

| | | | |
|---|---|---|---|
| 0261049 | 3/1988 | European Pat. Off. | 66/149 R |
| 1909593 | 9/1970 | Fed. Rep. of Germany | 66/151 |
| 2311520 | 9/1973 | Fed. Rep. of Germany | 66/152 |
| 694577 | 9/1965 | Italy | 66/152 |
| 57906 | 7/1946 | Netherlands | 66/150 |
| 2099027 | 12/1982 | United Kingdom | 66/152 |

*Primary Examiner*—Werner H. Schroeder
*Assistant Examiner*—John J. Calvert
*Attorney, Agent, or Firm*—Guido Modiano; Albert Josif

[57] ABSTRACT

This device for tensioning knitted fabric in a circular knitting machine. In particular of the large-diameter type, comprises a plurality of tensioning rollers arranged with their respective axes in succession along a broken line inscribed in a circumference which is concentric to the machine; the tensioning roller co-operate with presser counter-rollers to retain the knitted fabric, and actuation elements act on the tensioning rollers and rotate them to tension the knitted fabric while it is being formed. The actuation elements are constituted by hydraulic motors, each motor being arranged inside a respective one of the tensioning rollers and acting on the roller to controllably rotate it about its axis.

16 Claims, 2 Drawing Sheets

DEVICE FOR TENSIONING KNITTED FABRIC IN A CIRCULAR KNITTING MACHINE, IN PARTICULAR OF THE LARGE-DIAMETER TYPE

BACKGROUND OF THE INVENTION

The present invention relates to a device for tensioning knitted fabric in a circular knitting machine, in particular of the large-diameter type.

Devices for tensioning knitted fabric in large-diameter circular knitting machines are known, and comprise a plurality of tensioning rollers the axes whereof are arranged co-planar along a broken line, i.e. a polygonal, inscribed in a circumference which is concentric to the machine. The tensioning rollers are arranged below the knitting region of the needles and each roller is in contact with a presser roller; the knitted fabric formed by the needles is conveyed between the presser rollers and the tensioning rollers and these are rotated about their axis so as to apply a preset tension to the product while it is being formed.

In some types of device of this kind, for example of the type described in the published U.K. patent application No. 2.099.027A, the tensioning rollers are rotated individually by means of a lever connected to its related roller by means of a ratchet mechanism which allows said related roller to rotate in only one direction. The lever is actuated with reciprocating motion, and the advancement stroke, which is obtained by an element which rotates about the axis of the machine and progressively makes contact with all the levers, has no effect on the rotation of the related tensioning roller, since the ratchet mechanism operates freely, while the return stroke, which is obtained by means of a pneumatic actuator, rotates the related tensioning roller according to an angle of preset amplitude.

Though such devices succeed in tensioning the knitted fabric, they have some disadvantages. In particular, they are complicated in terms both of their manufacture and of their assembly, mostly as to the positioning of the pneumatic actuators. The levers actuating the tensioning rollers may furthermore accidentally catch in the fabric. Finally, the tension applied to the knitted fabric is not constant but intermittent due to the fact that during the advancement stroke of the lever the related tensioning roller does not move.

In other types of device, each tensioning roller has a shaft connected to the shaft of the contiguous rollers by means of conical gears, and a single electric motor capable of exerting torque even with zero rotation is used to serially rotate all the tensioning rollers. Such devices, though they have no elements protruding from the tensioning rollers, are extremely complicated from a mechanical point of view due to the conical-gear transmission between the rollers. With a transmission of this type, the device furthermore operates correctly only with a virtually perfect meshing of the conical gears, with adjustment problems during assembly and in maintenance. Furthermore, assuming all the rollers are tensioned at zero speed and that all the drops are excluded from the knitting, when they resume forming their row of knitting in sequence from one end to the other of the broken line along which the rollers are arranged, said new knitted rows are not tensioned adequately until fabric is generated along the entire broken line so that the commonly rotating rollers start to rotate and engage with the newly produced fabric.

SUMMARY OF THE INVENTION

The aim of the present invention is to obviate the above described disadvantages by providing a device for tensioning knitted fabric which is simple to operate and fully satisfies the most disparate tensioning requirements of the knitted fabric during knitting.

Within the scope of this aim, an object of the invention is to provide a device wherein each tensioning roller can be actuated independently from the others.

Another object of the invention is to provide a device which can be actuated according to a preset program by an electronic control element.

This aim, as well as these and other objects which will become apparent, are achieved by a device for tensioning knitted fabric in a circular knitting machine, particularly of the large-diameter type, as defined in the appended claims.

BRIEF DESCRIPTION OF THE DRAWINGS

The characteristics and advantages of the invention will become apparent from the description of a preferred but not exclusive embodiment of the device according to the invention, illustrated only by way of non-limitative example in the accompanying drawings, wherein.

DESCRIPTION OF THE PREFERRED EMBODIMENTS

Figure 1:
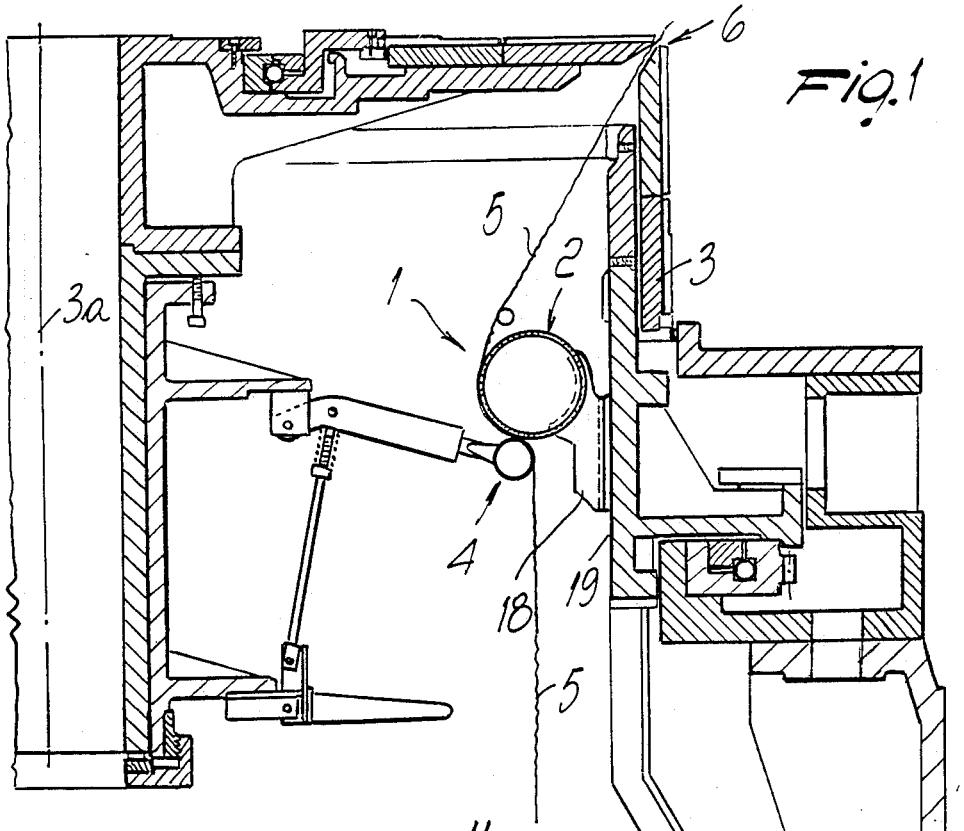
FIG. 1 is a schematic sectional view, taken along a vertical plane, of a large-diameter circular machine with the device according to the invention.
Figure 3:
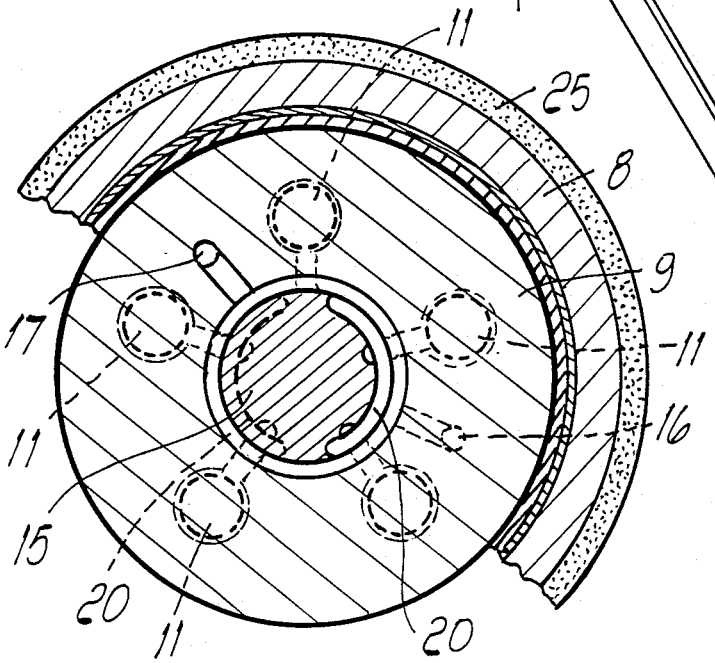
FIG. 3 is a sectional view of FIG. 2 taken along the line III—III.
Figure 2:
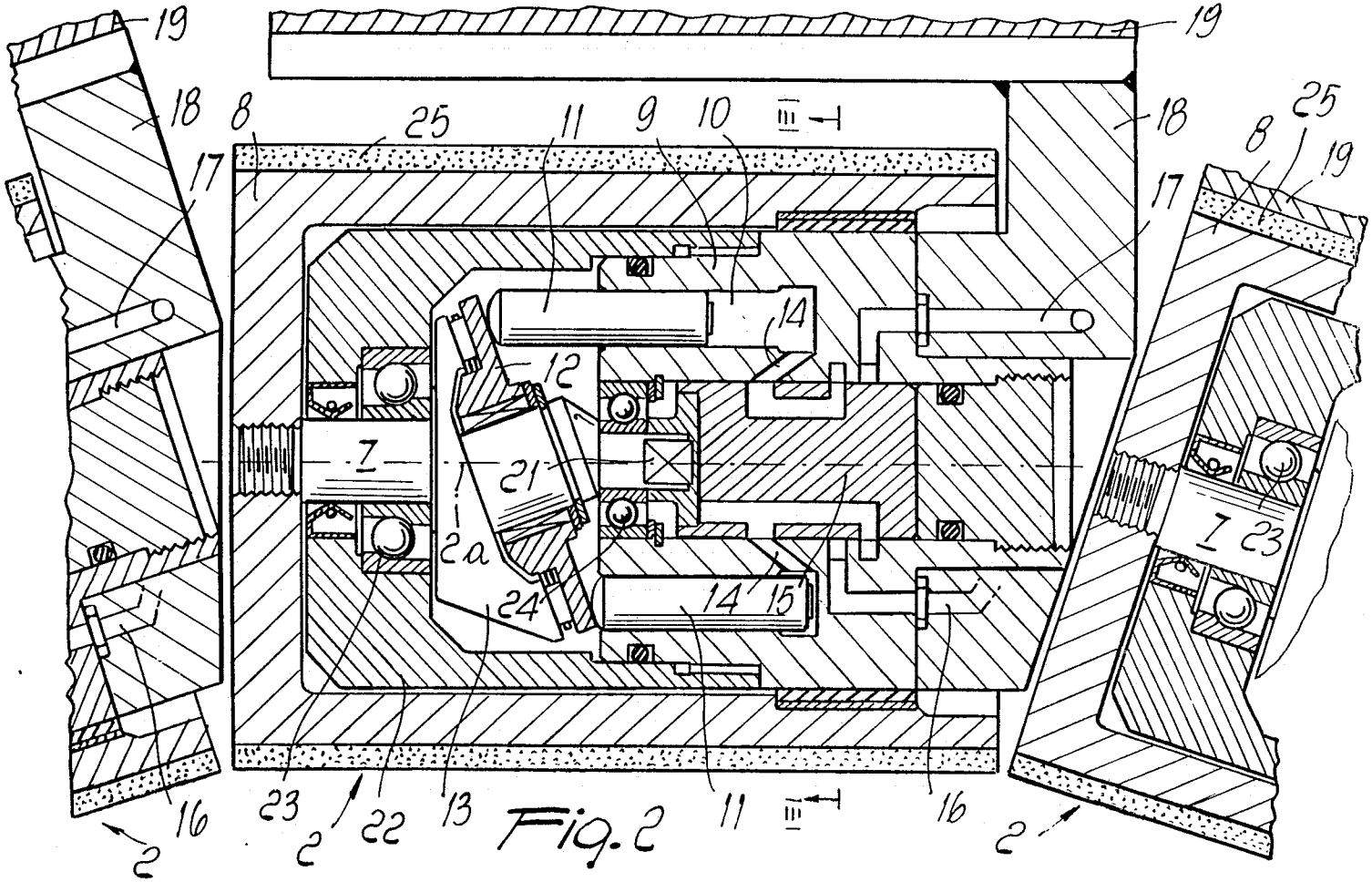
FIG. 2 is an enlarged sectional view taken along a horizontal plane which passes through the axis of a tensioning roller of the device according to the invention.

With reference to the above described figures, the device according to the invention, generally indicated by the reference numeral 1, comprises a plurality of tensioning rollers 2 arranged inside the needle cylinder 3 of the machine, with their axes arranged in succession along a broken line inscribed in a circumference centered on the axis 3*a* of the needle cylinder. More particularly, each tensioning roller 2 has its axis 2*a* arranged horizontally and co-operates, in a known manner, with presser counter-rollers 4 individually pushed by elastic means against the surface of each tensioning roller to retain the knitted fabric 5 which descends from the knitting region of the needles 6 towards the tensioning rollers 2 and then passes between the tensioning rollers and the pressure counter-rollers 4.

The tensioning rollers are rotated about their axes, so as to downwardly tension the knitted fabric, by means of actuation elements which, according to the invention, are constituted by motors, each motor being arranged inside a respective one of the tensioning rollers 2. The motors which rotate the tensioning rollers 2 are actuated by a pressurized fluid and, more particularly, in the illustrated embodiment they are of the positive-displacement hydraulic type with axial pistons, the output shaft 7 whereof is rigidly associated with the skirt 8 of the associated tensioning roller.

Each hydraulic motor is composed of a supporting body 9 in which a plurality of chambers 10 is defined; each of said chambers, arranged around the axis 2*a* of the tensioning roller 2, accommodates a piston 11. The pistons 11 act, with one of their ends, on a plate 12 which is inclined with respect to the axis *2a* and is supported in a known manner by a head 13 rotating rigidly with the output shaft 7.

Each chamber 10 has a duct 14 connected in sequence, by means of a distributor 15, to a delivery duct 16 and to a discharge duct 17 defined in a frame 18 which rotatably supports the skirt 8 and the distributor 15 and is fixed to the inner surface of the cylinder-holder 19 of the machine.

The distributor 15 comprises, in a known manner, a small cylinder which is arranged coaxially to the related tensioning roller and has, on its outer surface, circumferential grooves 20 which selectively connect the chambers 10 to the delivery duct 16 or to the discharge duct 17 when said small cylinder rotates about its own axis. The distributor 15 is rotated by the output shaft 7 as it is fixed to a small shaft 21 which extends from the head 13 coaxially to the output shaft 7, on the opposite side of the head with respect to the shaft 7.

The output shaft 7 is rotatably supported by a sleeve 22 with the interposition of bearings 23; said sleeve 22 is in turn supported by the supporting body 9 fixed to the frame 18. Bearings 24 are similarly interposed between the supporting body 9 and the shaft 21 and facilitate the rotation of the distributor 15.

The skirt 8 of each tensioning roller is conveniently covered with high-grip material 25, such as for example rubber, to achieve adequate friction on the knitted fabric.

The operation of the tensioning device according to the invention is evident from what has been described and illustrated, and in particular it is evident that by feeding a pressurized liquid to the various delivery ducts 16, the pistons 11 are moved reciprocatingly and consequently rotate the tensioning rollers 2. By appropriately varying the flowrate and the pressure of the liquid fed into the delivery ducts, the angular speed of the hydraulic motor and its motive torque can be varied, thus varying the traction force applied to the knitted fabric to adapt it to the various requirements.

By feeding the hydraulic motors independently it is furthermore possible to obtain different traction values in the various regions of the knitted fabric.

For particular knittings which require a slackening of the knitted fabric, the rotation of one or more hydraulic motors can be reversed by reversing their feed, thus rapidly reducing the traction force applied to the knitted fabric in a preset region or along its entire extension.

In practice it has been observed that the device according to the invention fully achieves the intended aim, since a high degree of flexibility in operation, capable of satisfying the most disparate knitting requirements, is achieved by using hydraulic motors arranged inside the tensioning rollers.

Furthermore there are no problems of interference of the knitted fabric with the elements which rotate the tensioning rollers, since said elements are arranged inside the tensioning rollers themselves.

The device thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. A device for tensioning knitted fabric in a circular knitting machine, in particular of the large-diameter type, comprising a plurality of tensioning rollers having each respective rotation axes arranged in succession along a broken line inscribed in a circumference which is concentric to said knitting machine, said tensioning rollers co-operating with presser counter-rollers to retain a knitted fabric, and actuation elements which rotate said tensioning rollers to tension said knitted fabric being formed, said actuation elements comprising a plurality of motors, each motor being arranged inside a respective one of said tensioning rollers and acting thereon to controllably rotate said respective one of said tensioning rollers about said respective rotation axis, said motors being fluidodynamic motors having an output shaft rigidly associated with an outer skirt of a respective one of said tensioning rollers.

2. A device according to claim 1, wherein said motors are positive-displacement hydraulic motors with axial pistons.

3. A device according to claim 1, wherein each of said hydraulic motors has a supporting body rigidly associated with a frame which rotatably supports said skirt of the respective tensioning roller, said supporting body defining a plurality of chambers arranged around the axis of said tensioning roller, each chamber slidably accommodating a piston, said pistons acting on a head with a plate arranged on a plane which is inclined with respect to a rotation axis of said tensioning roller, said head rotating rigidly with said skirt of said tensioning roller.

4. A device according to claim 3, wherein a rotatable distributor is accommodated inside said supporting body and rotates rigidly with said head.

5. A device according to claim 1, wherein said skirt of said tensioning rollers is covered with high-grip material.

6. A device for tensioning knitted fabric in a circular knitting machine, in particular of the large-diameter type, comprising a plurality of tensioning rollers having each respective rotation axes arranged in succession along a broken line inscribed in a circumference which is concentric to said knitting machine, said tensioning rollers co-operating with presser counter-rollers to retain a knitted fabric, and actuation elements which rotate said tensioning rollers to tension said knitted fabric being formed, said actuation elements comprising a plurality of motors, each motor being arranged inside a respective one of said tensioning rollers and acting thereon to controllably rotate said respective one of said tensioning rollers about said respective rotation axis, said motors being positive-displacement hydraulic motors with axial pistons.

7. A device according to claim 6, wherein said motors are fluidodynamic motors having an output shaft rigidly associated with an outer skirt of a respective one of said tensioning rollers.

8. A device according to claim 7, wherein each of said hydraulic motors has a supporting body rigidly associated with a frame which rotatably supports said skirt of the respective tensioning roller, said supporting body defining a plurality of chambers arranged around the axis of said tensioning roller, each chamber slidably accommodating a piston, said pistons acting on a head with a plate arranged on a plane which is inclined with respect to a rotation axis of said tensioning roller, said head rotating rigidly with said skirt of said tensioning roller.

9. A device according to claim 7, wherein each of said hydraulic motors has a supporting body rigidly associated with a frame which rotatably supports said skirt of the respective tensioning roller, said supporting body defining a plurality of chambers arranged around the axis of said tensioning roller, each chamber slidably accommodating a piston, said pistons acting on a head with a plate arranged on a plane which is inclined with respect to a rotation axis of said tensioning roller, said head rotating rigidly with said skirt of said tensioning roller, a rotatable distributor being accommodated inside said supporting body and rotating rigidly with said head.

10. A device according to claim 7, wherein said skirt of said tensioning rollers is covered with high-grip material.

11. A device for tensioning knitted fabric in a circular knitting machine, in particular of the large-diameter type, comprising;

a plurality of tensioning rollers, each tensioning roller of said plurality of tensioning rollers having a rotation axis around which said each tensioning roller rotates, a plurality of rotation axes being defined by each said rotation axis of said each tensioning roller, said plurality of rotation axes being mutually arranged so as to define a polygon which is concentric to an axis of the knitting machine, a plurality of pressure counter-rollers operating with said tensioning rollers for retention of a knitted fabric therebetween, actuation elements for the selective rotation actuation of said each tensioning roller, said actuation elements comprising a plurality of hydraulic motor means, each motor means of said plurality of hydraulic motor means being arranged inside a respective one of said tensioning rollers and acting thereon to controllably rotate said respective one of said tensioning rollers.

12. A device according to claim 11, wherein said each motor means has an output shaft means, said each tensioning roller comprising a rotating outer skirt means, said output shaft of a respective one of said motor means being rigidly associated with said outer skirt means of a respective one of said tensioning rollers.

13. A device according to claim 11, wherein said each motor means is a positive-displacement hydraulic motor having axial pistons.

14. A device according to claim 11, wherein said each motor means has an output shaft means, said each tensioning roller comprising a rotating outer skirt means, said output shaft of a respective one of said motor means being rigidly associated with said outer skirt means of a respective one of said tensioning rollers, said each motor means having a supporting body rigidly associated with a supporting frame means connected to a cylinder holder means of the knitting machine, said supporting body rotatably supporting said rotating outer skirt means of one of said tensioning rollers, said supporting body defining a plurality of chambers arranged around said rotation axis of said one of said tensioning rollers, said chambers having longitudinal axes being perpendicular to said rotation axis, each chamber of said chambers slidably accommodating a piston, each said piston acting on a head with a plate arranged on a plane which is inclined with respect to said rotation axis of said one of said tensioning rollers, said head rotating rigidly with said skirt of said one of said tensioning rollers.

15. A device according to claim 14, wherein a rotatable distributor is accommodated inside said supporting body and rotates rigidly with said head, said distributor comprising a small cylinder being arranged coaxially with said one of said tensioning rollers, a delivery duct means and a discharge duct means being provided for carrying a pressurized fluid, connection duct means being provided between said chambers and said delivery and discharge duct means, said connection duct means communicating selectively with said delivery and discharge duct means by means of circumferential groove means provided in said small cylinder, said distributor being fixed to said head coaxially with and opposite to said output shaft means by means of shaft means, said supporting body rigidly supporting a sleeve means which rotatably supports said output shaft means by means of first bearing means, said supporting body means rotatingly supporting said shaft means of said distributor by means of second bearing means.

16. A device according to claim 12, wherein said skirt of said tensioning rollers is covered with high-grip material.

* * * * *